United States Patent [19]

Woodley

[11] 4,102,467

[45] Jul. 25, 1978

[54] TAPERED PLASTIC CONTAINER WITH SEAMED METAL END AND METHOD FOR MAKING IT

[75] Inventor: Keith R. Woodley, San Francisco, Calif.

[73] Assignee: Wescan, Inc., San Francisco, Calif.

[21] Appl. No.: 793,732

[22] Filed: May 4, 1977

[51] Int. Cl.[2] ..... B65D 7/42
[52] U.S. Cl. ..... 220/67
[58] Field of Search ..... 220/66, 67

[56] References Cited

U.S. PATENT DOCUMENTS

| | | | |
|---|---|---|---|
| 3,410,939 | 11/1968 | Driza et al. | 220/67 X |
| 3,491,936 | 1/1970 | Fox | 220/67 X |
| 3,524,568 | 8/1970 | Nughes | 220/67 |
| 3,550,840 | 12/1970 | Fox | 220/67 X |
| 3,685,685 | 8/1972 | Phillips | 220/67 |

*Primary Examiner*—Stephen Marcus

[57] ABSTRACT

A container which includes a thermoformed or injection molded rigid or semi-rigid plastic body and a metal end seamed upon and closing one open end of the body. Critical shaping of the plastic container body permits seaming a conventional metal end upon the body with conventional seaming techniques and tooling.

5 Claims, 8 Drawing Figures

TAPERED PLASTIC CONTAINER WITH SEAMED METAL END AND METHOD FOR MAKING IT

BACKGROUND

For years metal cans have been used to pack and ship a multitude of products for industrial and consumer consumption. Traditionally, such cans comprised a cylindrical metal container body with a metal end seamed upon and closing one or both ends of the body. More recently, others have suggested plastic container bodies sealed with metal ends.

There have been difficulties, however,in applying the hard metal ends to the softer plastic container bodies. For instance, when one tries to seam a metal end onto a plastic body, the sharp metal rolled edge often cuts through the softer plastic material negating an effective seam. Moreover, special exterior molds and supports are usually required to support or envelope the container body to prevent it from being crushed when conventional tooling force is applied during the seaming process.

Among other objectives, the purpose of this invention is to overcome the two above-mentioned difficulties. By designing the container flange with a specific tapered shape, the resulting seam develops a balanced pressure distribution in the body hook. Further, by providing a tapered body and a sharp radius at the juncture of the body flange and the remainder of the container body, it is possible to perform the seaming operation with conventional techniques and tooling. Special supporting molds can be eliminated because the specifically shaped plastic body, itself, can withstand the resultant smaller seaming forces without danger of buckling.

Other objects and advantages of this invention will become obvious to those skilled in the art upon consideration of the following detailed description and the drawings illustrating a preferred embodiment.

IN THE DRAWINGS

DESCRIPTION OF THE PREFERRED EMBODIMENT

Figure 1:
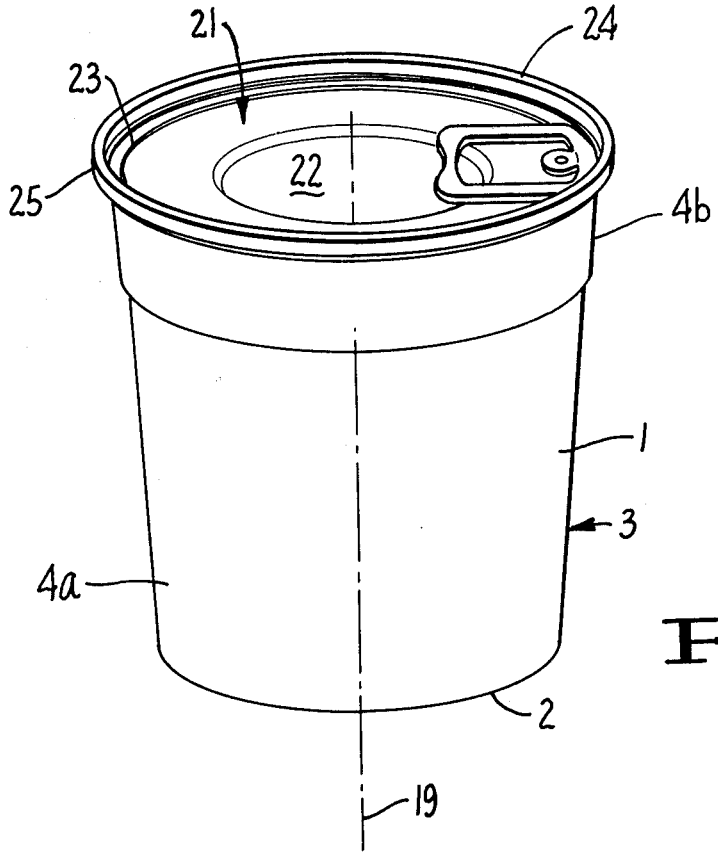
FIG. 1 is a perspective view of the plastic container body with the metal end seamed thereto.

Referring now to the drawings in detail, FIG. 1 illustrates a container having the plastic body and metal end seamed upon it in accordance with this invention. The plastic container body 1 is of a one-piece injection molded or thermoformed construction and includes a bottom wall 2 and a tapered upstanding side wall 3. Polyethylene and polypropylene are suitable plastic materials.

Figure 2:
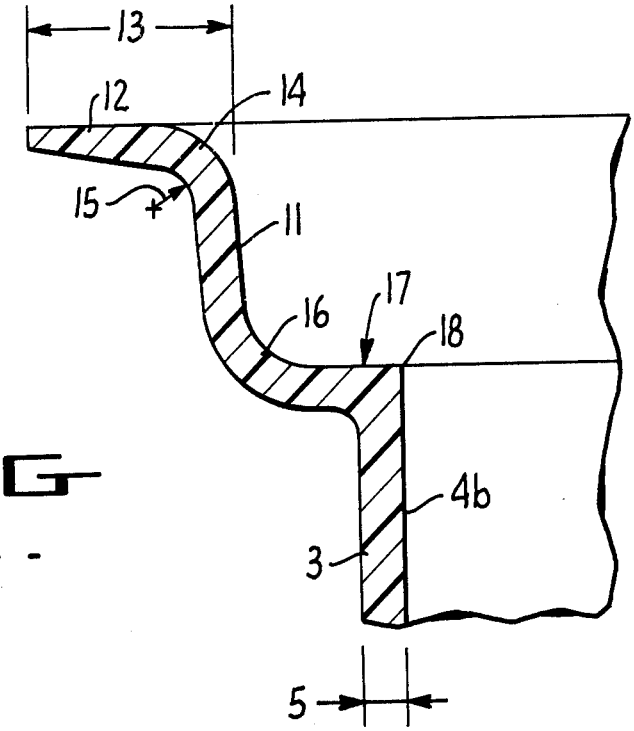
FIG. 2 is an enlarged fragmentary vertical cross-sectional view taken through the upper portion of the container body.

As shown in FIGS. 1 and 2, the upstanding side wall 3 has a generally flat tapered lower major portion 4*a* and a generally cylindrical upper portion 4*b*. In this particular embodiment of the invention, the side wall 3 has a thickness 5 of 0.020 inches. The tapered body provides axial strength along axis 19 to enhance the seaming operation hereafter described.

The cylindrical portion 4*b* of the upstanding side wall 3 includes an upper seam forming portion 11 which terminates at the free end thereof in a gradually tapered radially outwardly directed flange 12. The flange 12 gradually reduces in thickness with the free end being one-half the thickness of the side wall 3 and seam forming portion 11.

In this particular embodiment of the invention, the flange 12 has a flange length 13 of between 0.110 and 0.115 inches. Flange 12 connects to the upper seam forming portion 11 through an outer shoulder section 14 having a sharp radius of curvature 15 between 0.010 and 0.015 inches or in the order of one-half to three-quarters of the side wall thickness. The upper seam forming portion 11 connects to the upper portion 4*b* of upstanding side wall 3 through an intermediate radius 16. Intermediate radius 16 has a generally flat inner metal end supporting surface 17 forming an approximately 90° angle 18 with the vertical axis 19 of the container body.

Figure 3:
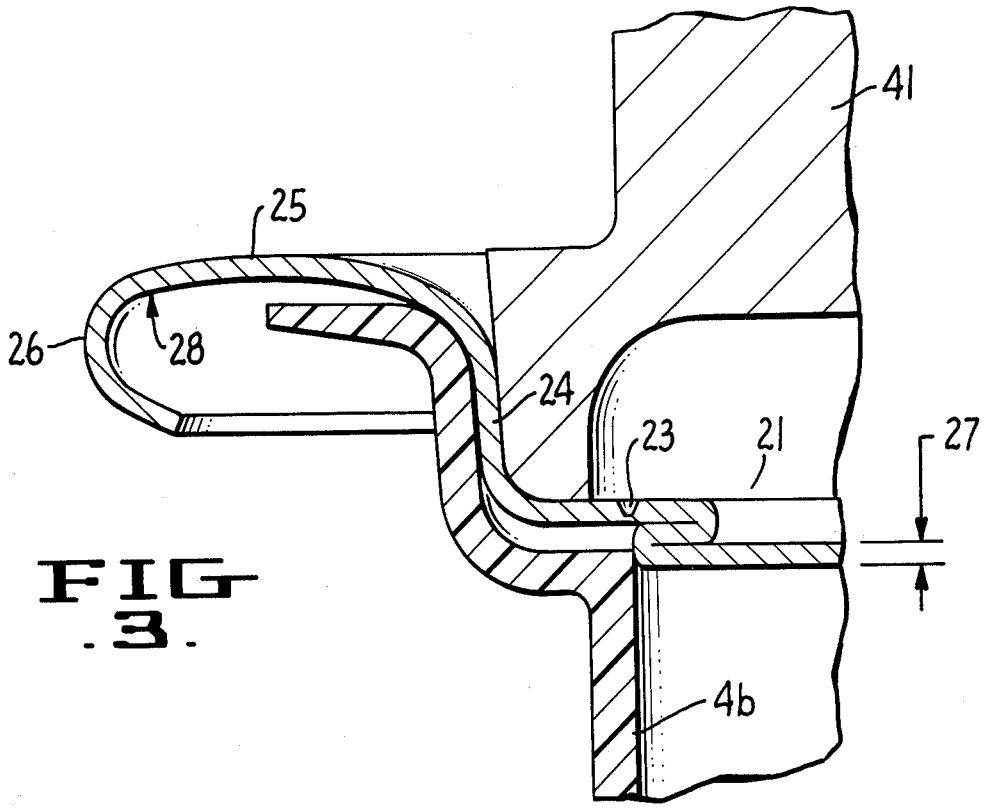
FIG. 3 is a fragmentary vertical cross-sectional view showing the container body with the initial positioning or make-up of a preformed metal end upon it prior to seaming.

In accordance with this invention, a metal end 21 closes the open upper end of the container body. The end preferrably is aluminum and of well-known preformed design for metal containers. The end 21, as is shown in FIGS. 1 and 3, is of the easy opening type and includes a removable end panel 22 which is defined by a peripheral score line 23. The end 21 further includes a chuck wall 24 and a seaming channel 25 which terminates at its free end in a curl 26. In this particular embodiment, end 21 is chosen so that thickness 27 is about 0.010 inches. End 21 is attached to the container body 1 using a conventional double seaming operation. In order to insure a proper seam between the end 21 and the container body 1 sealing compound 28 is applied to the seaming channel 25.

Figure 5:
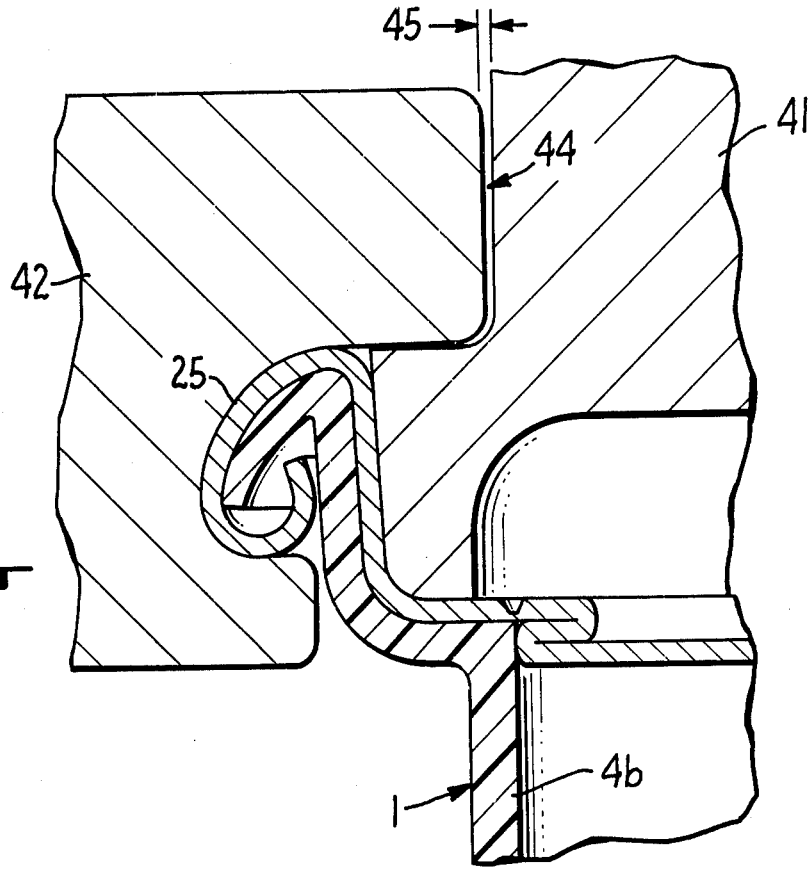
FIG. 5 is a fragmentary vertical cross-sectional view of the container and tooling after the first step of the seaming operation.
Figure 4:
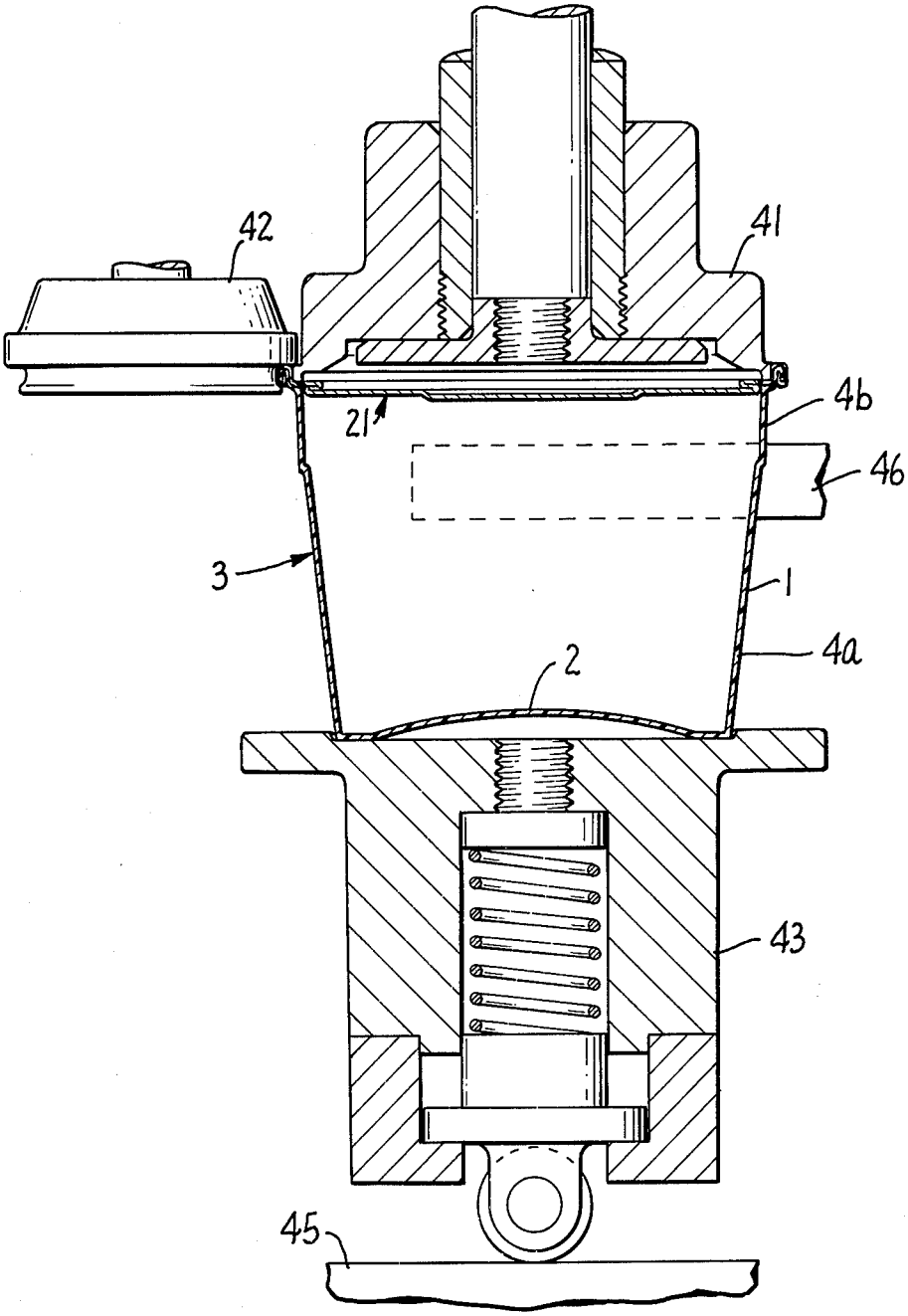
FIG. 4 is a fragmentary vertical sectional view taken through the tooling used to seam the metal end onto the container body showing the general position of the tooling, container body and metal end during the seaming cycle.
Figure 6:
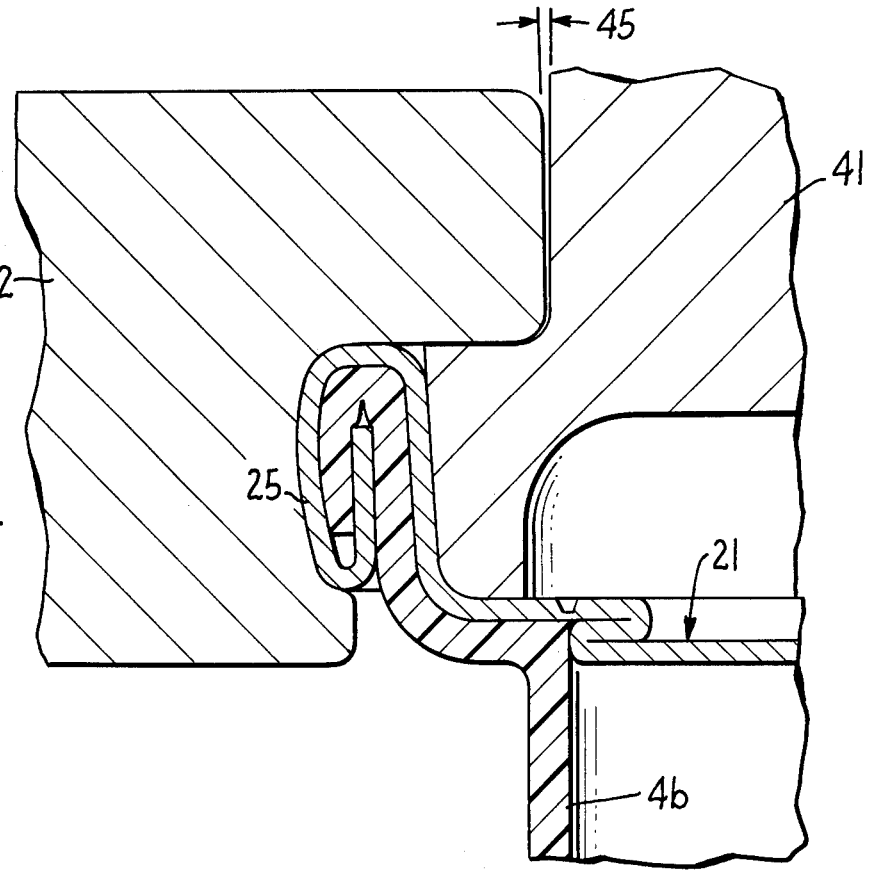
FIG. 6 is a fragmentary vertical cross-sectional view of the container and tooling after the second step of the seaming operation.
Figure 7:
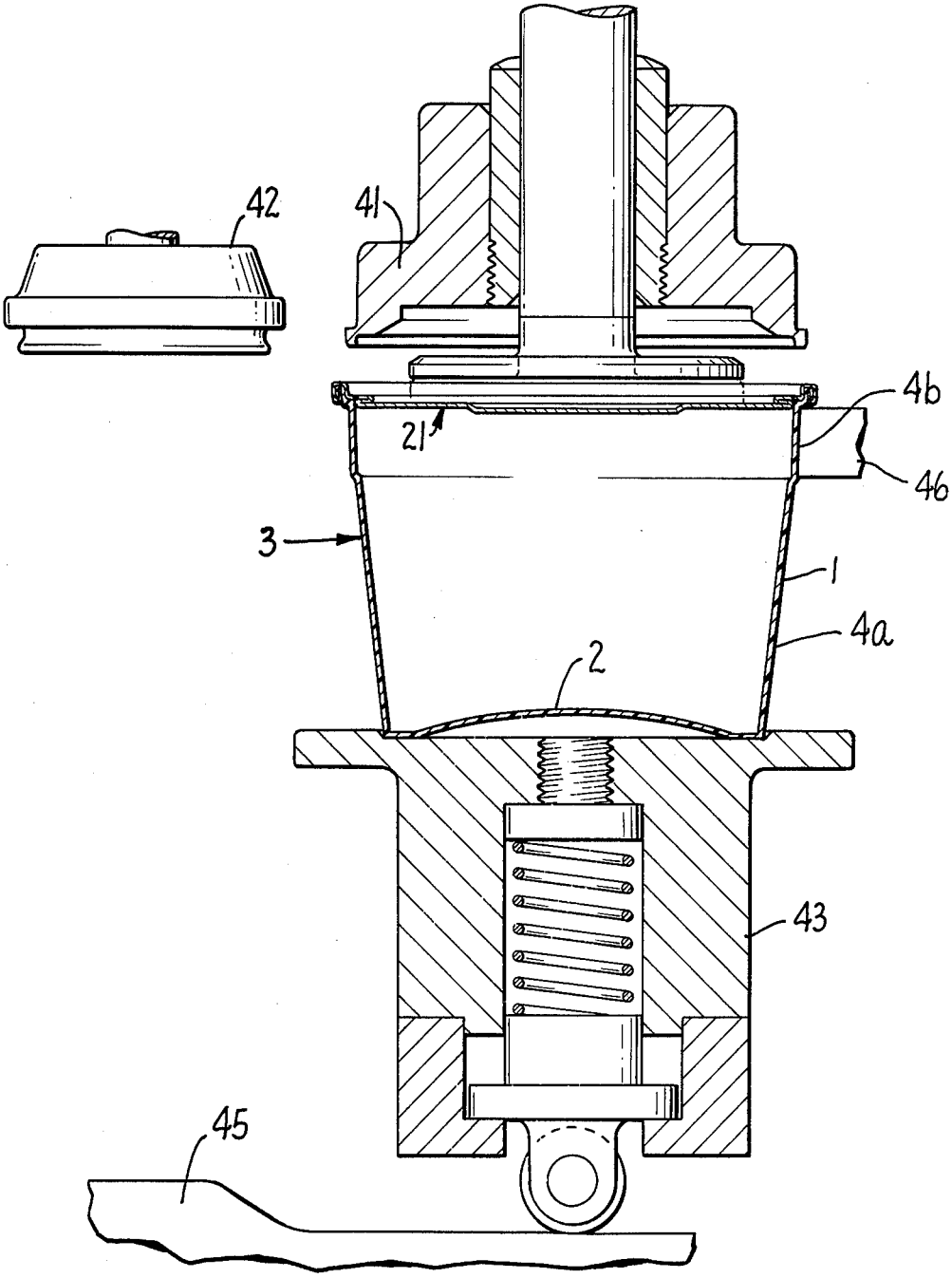
FIG. 7 is a fragmentary vertical sectional view taken through the tooling used to seam the metal end onto the container body showing the position of the tooling, container body and metal end after completion of the seaming cycle.

FIGS. 3, 4, 5, 6 and 7 illustrate the process whereby the metal end 21 is seamed onto the plastic container body 1. In FIG. 3, the metal end 21 is held in place on seaming chuck 41 by locating it between the chuck and container body 1 which is moved upwardly by seaming lifter 43. In FIGS. 5 and 6, the container body 1 is forced upwardly by cam operated seaming lifter 43 against seaming chuck 41. Then seaming roll 42, driven in a horizontal direction by a revolving cam (not pictured in the drawing), rolls seaming channel 25 and curl 26 into the positions shown in FIGS. 5 and 6. In FIG. 6 seaming roll 42 completes the double-seaming operation and forms the channel 25 into the tight double seam of FIG. 8. A small separation 45 exists between the upper portions of seaming roll 42 and seaming chuck 41 when seaming roll 42 has travelled its maximum horizontal distance. As a safety feature of this invention, seaming chuck 41 is designed so that the upper portion of seaming chuck 41 acts as a safety stop 44 to prevent further horizontal travel of seaming roll 42 should the horizontal displacement of seaming roll 42 be out of adjustment. This safety stop 44 eliminates the possibility that cover hook 33 will cut or fracture upper seam forming portion 11 or flange 12 because of pressure applied from seaming roll 42. FIG. 7 shows the sealed container after completion of the seaming operation with seaming lifter 43 retracted by cam 45 and the container resting in mold turret 46.

Figure 8:
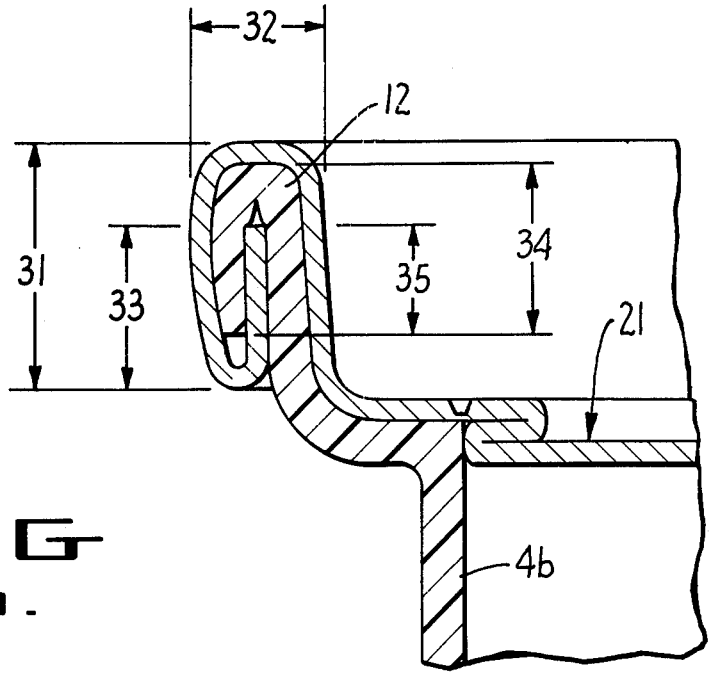
FIG. 8 is a fragmentary vertical cross-sectional view of the container to illustrate certain dimensions and shaping critical to the proper practice of the invention.

FIG 8 illustrates certain important dimensions of this particular invention. Seam length 31 is in the range of not less than 0.115 nor more than 0.125 inches. Seam thickness 32 is between 0.063 and 0.067 inches. Cover nook 33, formed by the free end of seaming channel 25 and curl 26, is between 0.074 and 0.086 inches, while body hook 34, formed by radially outwardly directed flange 12, is between 0.074 and 0.086 inches. The overlap portion 35 between the cover hook 33 and the body hook 34 is about 40% of the seam length 31. These dimensions are selected such that a tight seal may be formed between the plastic container body 1 and the metal end 21 with only about 65 pounds of upward pressure required from seaming lifter 43. Conventional designs require much more than 65 pounds of upward pressure. That, in turn, increases the probability that the plastic container body 1 will be crushed or deformed during the seaming operation in prior art container designs.

I claim:

1. A molded one-piece plastic container body including a bottom wall; an upstanding side wall with an open upper end adapted to be closed by a metal end; and upper seam forming portion carrier on said side wall and being radially outwardly offset from the next adjacent portion of said side wall; an intermediate radius having a generally flat inner end supporting surface generally perpendicular to the axis of the container body and interconnecting said side wall and said upper seam forming portion; a radially outwardly directed flange carried upon said seam forming portion and gradually tapering from a thickness substantially equal to the thickness of the upstanding side wall to a thickness generally one-half that of said upstanding side wall at its outer end, said flange being connected to said upper seam forming portion through an outer shoulder section of uniform thickness and having a radius of curvature substantially less than said wall thickness.

2. The container body of claim 1 wherein the major portion of said side wall tapers outwardly and upwardly.

3. The container body of claim 1 wherein said radius of curvature is in the range of one-half to three-quarters of said side wall thickness.

4. The container body of claim 1 further comprising an easy opening metal end including a removable end panel which is defined by a peripheral score line and having a cover hook seamed between said flange and upper seam forming portion without reduction in thickness of the wall of the upper seam forming portion anywhere along the length of the cover hook.

5. The container body and metal end of claim 4 having a seam length between 0.115 and 0.125 inches, a seam thickness between 0.063 and 0.067 inches, a cover hook between 0.074 and 0.086 inches, and a body hook between 0.074 and 0.086 inches, said body hook having an overlap of about 40% of said seam length.

* * * * *